US005473965A

United States Patent [19]

Chen

[11] Patent Number: 5,473,965

[45] Date of Patent: Dec. 12, 1995

[54] AUTOMATIC SCREW FEEDING MECHANISM FOR AN AUTOMATIC SCREW DRIVING DEVICE

[76] Inventor: Abraham Chen, 4F, No. 36-5, Tien-Mu E. Rd. Shih-Lin Dist., Taipei, Taiwan

[21] Appl. No.: 333,440

[22] Filed: Nov. 2, 1994

[51] Int. Cl.[6] ..... B25B 23/04

[52] U.S. Cl. ..... 81/434; 81/435

[58] Field of Search ..... 81/57.37, 433, 81/434, 435

[56] References Cited

U.S. PATENT DOCUMENTS 5,138,913 8/1992 Chen ..... 81/434
5,284,074 2/1994 Chen ..... 81/435 X

FOREIGN PATENT DOCUMENTS 2404990 2/1974 Germany ..... 81/434

*Primary Examiner*—D. S. Meislin
*Attorney, Agent, or Firm*—Hoffmann & Baron

[57] ABSTRACT

An automatic screw feeding mechanism includes a feed belt receiving unit including a hollow housing which is provided with a limiting unit that is connected releasably to a stop unit of a hollow casing. A feed belt extends into the housing. A retaining unit is adapted to engage the feed belt to align a first screw with a tool bit of an automatic screw driving device which is connected releasably to and which extends into the casing. A guide plate is connected to the housing and has a front end that is spaced apart from the housing and that is adapted to engage an operating surface. An elongated guide unit is received in the casing and is connected releasably to the housing. An actuating unit includes a seat member which is received in the casing and which is movable forward and rearward relative to the guide unit. The casing normally engages the seat member so as to enable the seat member to move synchronously therewith relative to the guide unit from an initial position to a second position, wherein the tool bit extends into the housing to drive rotatably the first screw into the operating surface when the casing is urged by the automatic screw driving device. The casing and the seat member are movable back to the initial position after the execution of the screw driving operation so that the retaining unit can align a second screw with the tool bit.

11 Claims, 5 Drawing Sheets

AUTOMATIC SCREW FEEDING MECHANISM FOR AN AUTOMATIC SCREW DRIVING DEVICE

BACKGROUND OF THE INVENTION

1. Field of the Invention

This invention relates to an automatic screw driving device, more particularly to an automatic screw feeding mechanism for an automatic screw driving device.

2. Description of the Related Art

U.S. Pat. No. 5,138,913 by the applicant discloses an automatic screw feeding mechanism for an automatic screw driving device. The patented automatic screw feeding mechanism includes a plurality of components which are assembled in a hollow casing. It is noted that the casing must be removed when maintaining or troubleshooting the patented automatic screw feeding mechanism. However, the various components are usually when the hollow casing is removed, thereby inconveniencing and complicating the maintenance and troubleshooting procedures. Furthermore, the hollow casing is connected threadably to the automatic screw driving device. Therefore, rotation of the automatic screw driving device relative to the hollow casing is limited. It is thus inconvenient to drive a screw into an uneven operating surface or an operating surface which is adjacent to a corner of two walls.

SUMMARY OF THE INVENTION

Therefore, the main objective of the present invention is to provide an automatic screw feeding mechanism which can be easily assembled and disassembled so as to facilitate its maintenance and troubleshooting.

According to the present invention, an automatic screw feeding mechanism is to be used with an automatic screw driving device which includes a rotatable tool bit and means for axially rotating the tool bit, and is adapted for use with a feed belt which includes an elongated strap that holds a plurality of spaced and aligned screws. The strap has two opposed longitudinal sides which are provided with a plurality of spaced engaging units. The automatic screw feeding mechanism comprises a feed belt receiving unit which includes a hollow housing. The hollow housing has a front end portion formed with a belt passage that permits passage of the feed belt therethrough and an open rear end portion which is provided with a limiting unit and which permits extension of the tool bit therethrough and into the housing. The receiving unit further includes retaining means which is adapted to engage releasably the engaging units on the strap of the feed belt to align one of the screws with the tool bit. A guide plate is connected to the housing of the feed belt receiving unit and has a front end that is spaced apart from the front end portion of the housing and that is adapted to engage an operating surface. An elongated guide unit has a front end with a connection portion which is connected releasably to the open rear end portion of the housing of the feed belt receiving unit. The guide unit is formed with a longitudinal passage to permit passage of the tool bit therethrough and into the housing. An actuating unit includes a seat member which is connected movably to the guide unit. The seat member is movable forward and rearward relative to the guide unit. The actuating unit further includes an elongated actuating member which is disposed in the seat member and which extends into the housing via the guide unit. An elongated hollow casing has open front and rear ends. The open rear end is adapted to be coupled releasably to one end of the automatic screw driving device. The casing receives the housing of the feed belt receiving unit, the guide unit and the seat member therein. The open front end is provided with a stop means which engages releasably the limiting unit of the housing of the feed belt receiving unit so as to prevent disengagement of the guide unit and the receiving unit from the open front end of the hollow casing. The casing normally engages the seat member so as to enable the seat member to move synchronously with the casing relative to the guide unit from an initial position to a second position, wherein the tool bit extends into the housing of the receiving unit to drive rotatably an aligned one of the screws into the operating surface and releases the aligned one of the screws from the strap during a screw driving operation, when the casing is urged by the automatic screw driving device. The casing and the seat member are movable back to the initial position after the execution of the screw driving operation. The actuating member actuates the retaining means to engage succeeding ones of the engaging units on the feed belt in order to align a succeeding one of the screws with the tool bit when the casing moves back to the initial position.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
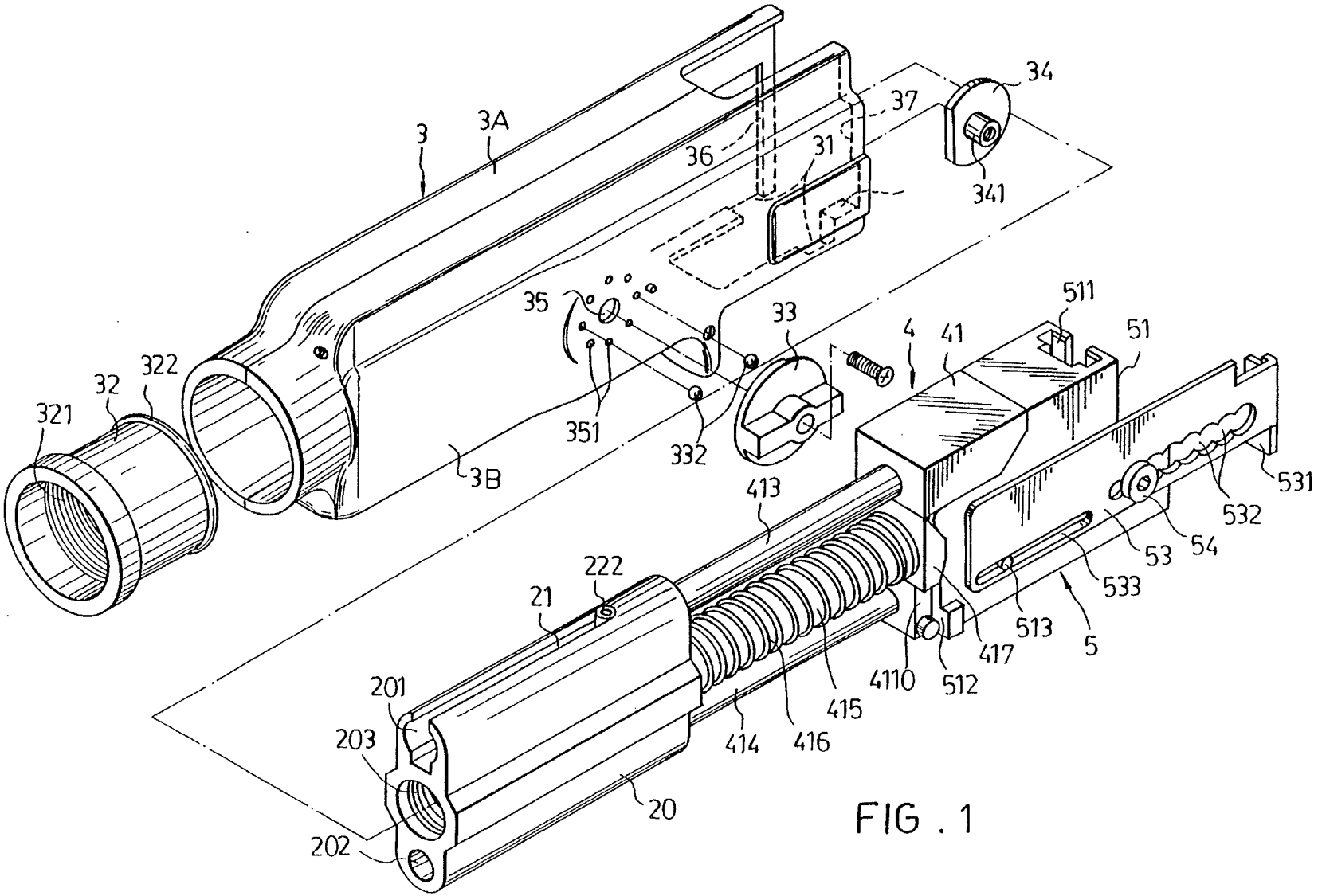
FIG. 1 is a partly exploded view showing an automatic screw feeding mechanism according to the present invention.
Figure 2:
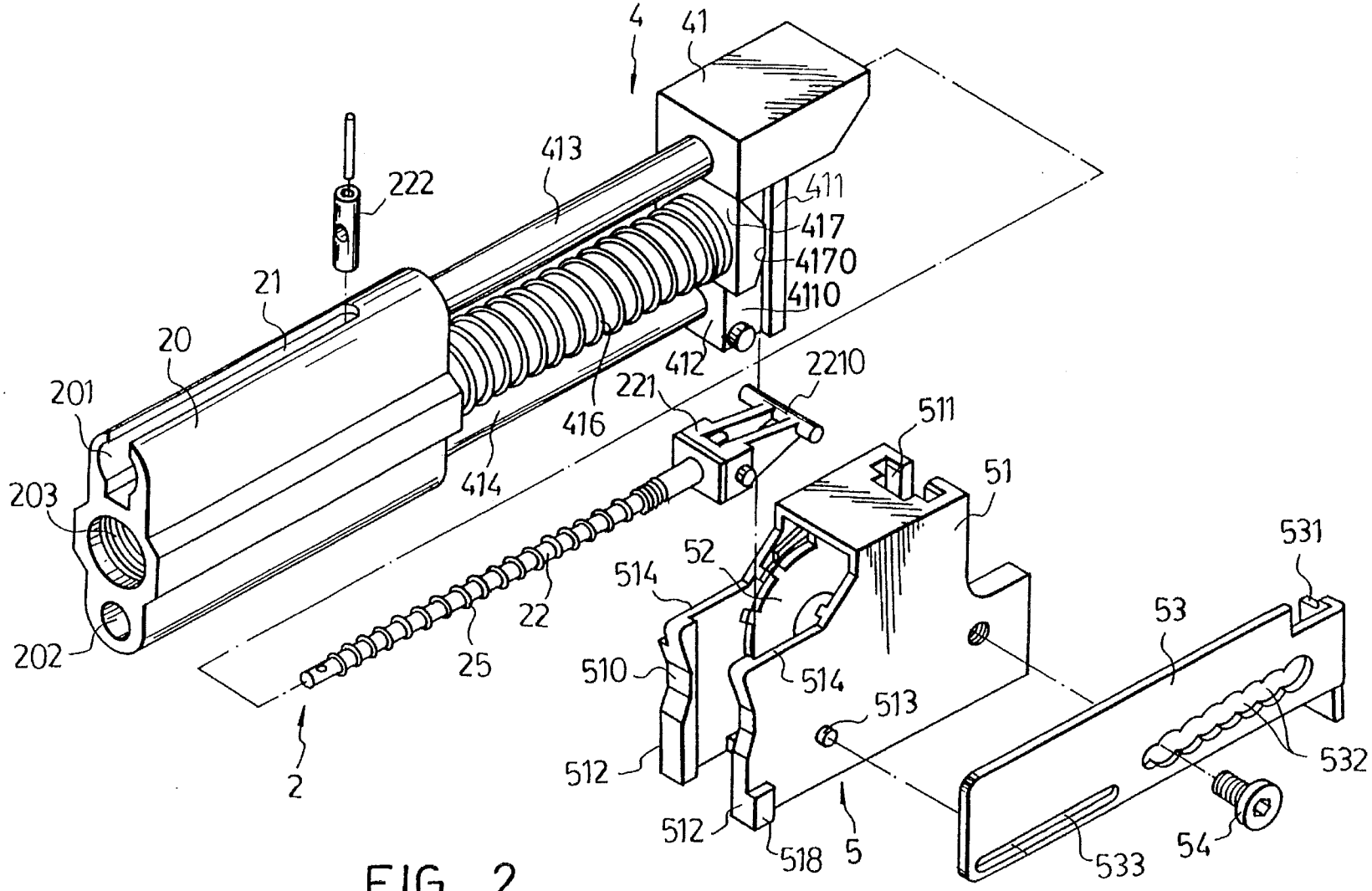
FIG. 2 is another partly exploded view showing the automatic screw feeding mechanism according to the present invention, the hollow casing being absent from the drawing.
Figure 8:
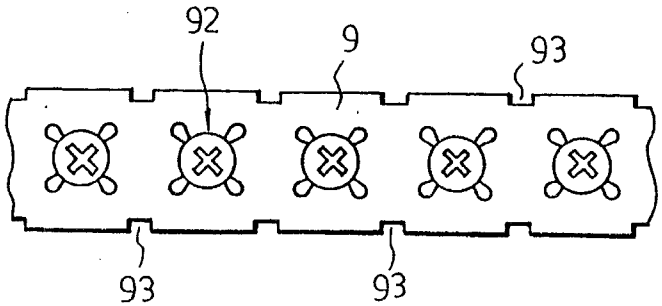
FIG. 8 is a schematic view showing a feed belt.

Referring to FIGS. 1 and 2, an automatic screw feeding mechanism according to the present invention is to be used with an automatic screw driving device and includes a feed belt receiving unit 5, a guide plate 53, an elongated guide unit 4, an actuating unit 2, a hollow connector 32 and an elongated hollow casing 3. The automatic screw driving device 6 (FIGS. 5 to 7) includes a rotatable tool bit 61 and a rotating means (not shown) for axially rotating the tool bit 61. The automatic screw feeding mechanism is adapted for use with a feed belt 9 (FIGS. 5, 6 and 8) which includes an elongated strap 91 that holds a plurality of spaced and aligned screws 92. The strap 91 has two opposed longitudinal sides which are provided with a plurality of spaced engaging units 93, such as guide notches.

The feed belt receiving unit 5 includes a hollow housing 51 which has a front end portion formed with a belt passage 511 that permits the passage of the feed belt 9 therethrough. The housing 51 further has an open rear end portion with two opposed vertical walls 514 on which a limiting unit is provided. In the present embodiment, the limiting unit is a pair of opposed outwardly extending projections 518 (only one is shown). Each of the vertical walls 514 is provided with an inwardly extending protrusion 512. Each of the protrusions 512 has an indented section 510. One of the vertical walls 514 is further provided with a mounting stud 513 which extends outwardly therefrom. The tool bit 61 of the automatic screw driving device 6 can extend into the housing 51 through the space formed between the protrusions 512 of the housing 51.

Figure 4:
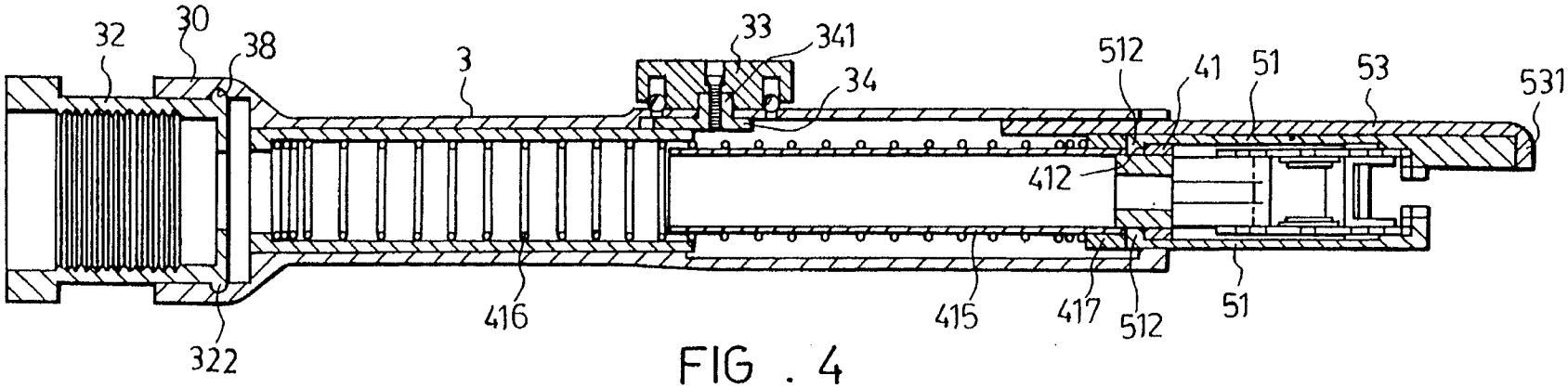
FIG. 4 is another sectional view illustrating the assembled automatic screw feeding mechanism shown in FIG. 3.
Figure 3:
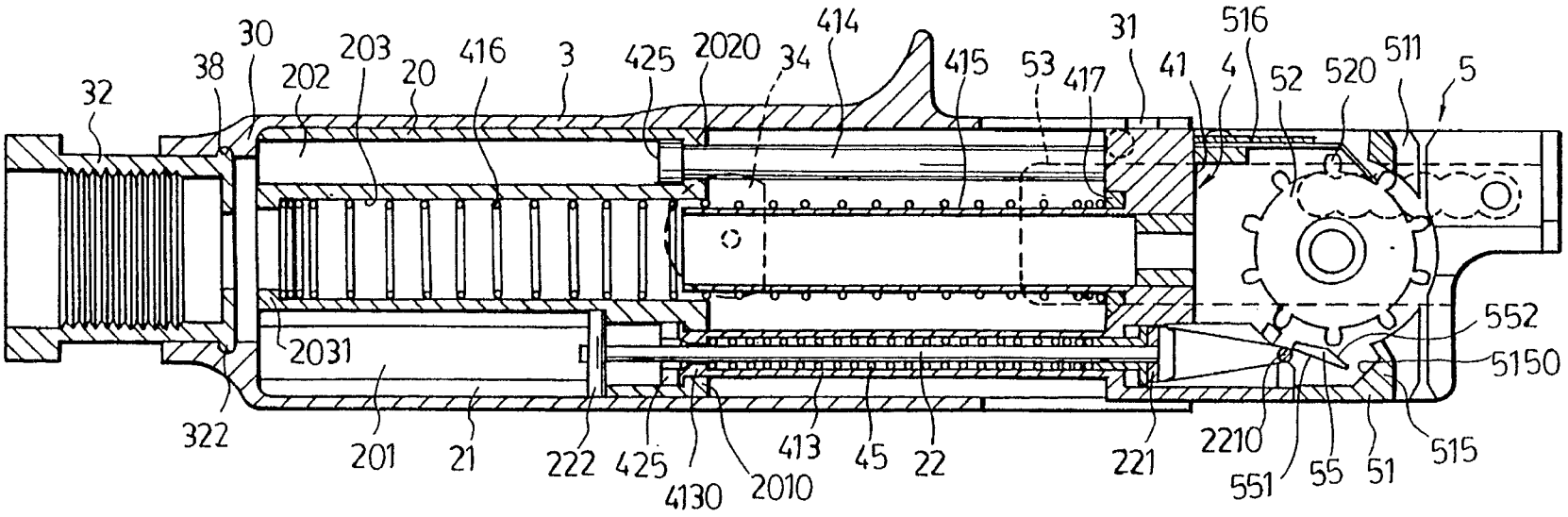
FIG. 3 is a sectional view illustrating the assembled automatic screw feeding mechanism according to the present invention, the casing being located in an initial position.

Referring now to FIGS. 2, 3 and 4, the feed belt receiving unit 5 further includes a retaining means which is adapted to engage releasably the engaging units 93 on the strap 91 of the feed belt 9 to align one of the screws 92 with the tool bit 61. The retaining means includes a ratchet wheel 52 which is mounted rotatably on an inner surface of each of the vertical walls 514 and which has a periphery formed with a plurality of angularly spaced teeth 520. A pawl member 516 is disposed in the housing 51 and is associated with the ratchet wheels 52 to arrest counterclockwise rotation of the ratchet wheels 52. In the present embodiment, the pawl member 516 is a spring plate which has a forked end that includes two plate sections extending into a tooth space formed between two adjacent teeth 520 of the respective ratchet wheels 52. A guide member 55 is mounted on each of the inner surfaces of the vertical walls 514. In the present embodiment, each of the guide members 55 has a first inclined guide surface 551 opposite to the ratchet wheel 52 and a second inclined guide surface 552 adjacent to the ratchet wheel 52. Each of the vertical walls 514 has a guide protuberant 515 which projects from the inner surface thereof and which is located adjacent to the guide member 55. Each of the guide protuberants 515 has a slant surface 5150 which faces a junction of the first and second inclined guide surfaces 551 and 552 of the respective guide member 55.

Figure 5:
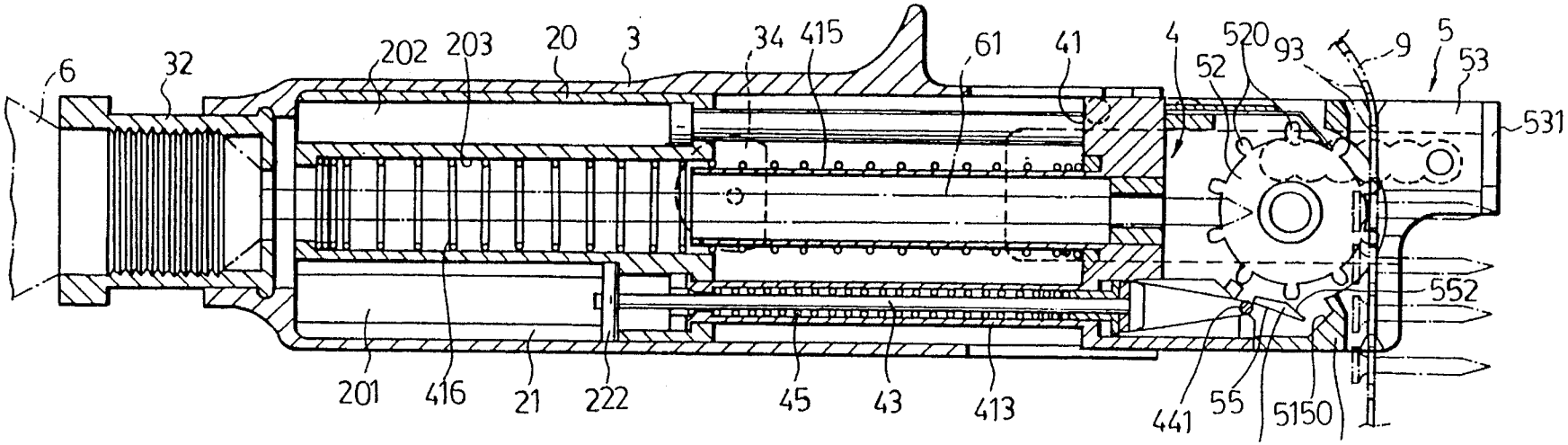
FIG. 5 is a view similar to that of FIG. 3, illustrating an automatic screw driving device being connected to the assembled automatic screw feeding mechanism, a feed belt being received in a feed belt receiving unit of the automatic screw feeding mechanism.
Figure 7:
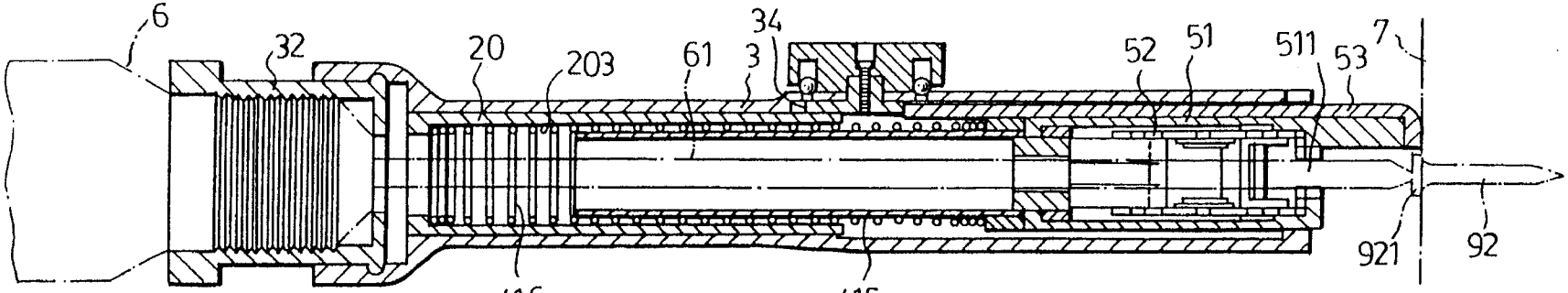
FIG. 7 is another sectional view illustrating the assembled automatic screw feeding mechanism shown in FIG. 6, the feed belt being absent from the drawing.
Figure 6:
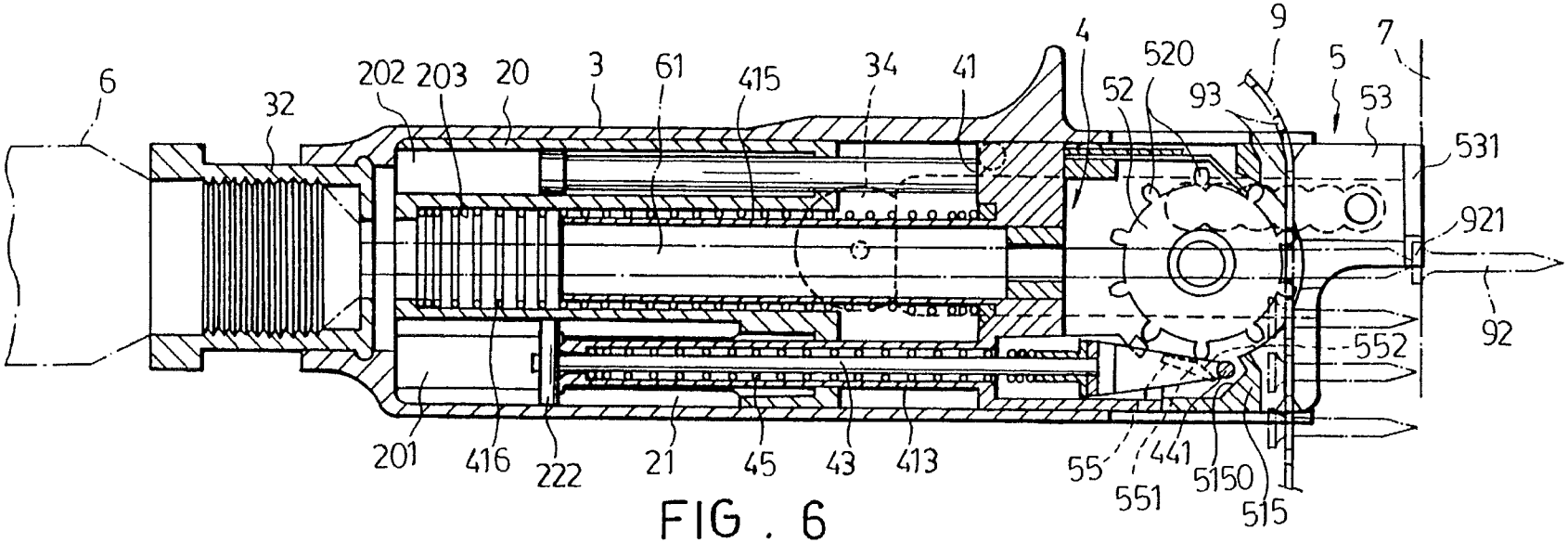
FIG. 6 is a sectional view illustrating the assembled automatic screw feeding mechanism shown in FIG. 5 when the casing is located in a second position.

Referring to FIGS. 1 and 2, the guide plate 53 has a front end 531 and a rear end which is opposite to the front end. The guide plate 53 is formed with a series of longitudinally arranged positioning holes 532 adjacent to the front end 531 thereof and a longitudinally extending slot 533 which is located adjacent to the rear end thereof and which receives the mounting stud 513 of the housing 51 slidably therein. In the present embodiment, the positioning holes 532 are intercommunicated with each other. The guide plate 53 is connected to the housing 51 of the feed belt receiving unit 5 by extending a locking bolt 54 through a selected one of the positioning holes 532 so as to engage threadedly the housing 51 in such a manner that the front end 531 of the guide plate 53 is spaced apart from the front end portion of the housing 51. The front end 531 is adapted to engage an operating surface 7 (FIGS. 5, 6 and 7). It should be noted that extension of the locking bolt 54 through another one of the positioning holes 532 can vary the distance between the front end 531 of the guide plate 53 and the front end portion of the housing 51.

The elongated guide unit 4 includes a mounting seat 41 which has two opposite side walls 411 and a mounting wall 412 which interconnects the side walls 411. Each of the side walls 411 is formed with a mounting groove 4110 which engages releasably a respective one of the inwardly extending protrusions 512. The guide unit 4 further includes two hollow guide rods 413, 414 which extend from the mounting wall 412 of the mounting seat 41 and a hollow bit guide 415 which extends between and parallel to the guide rods 413. Each of the guide rods 413, 414 has a distal end portion which is provided with an enlarged block member 425. The guide rod 413 is provided with an inwardly extending stop member 4130 adjacent to the block member 425.

The actuating unit 2 includes a seat member 20 which is formed with two first channels 201, 202 and a second channel 203. Each of the guide rods 413 extends slidably into a respective one of the first channels 201, 202, while the bit guide 415 extends slidably into the second channel 203. Each of the first channels 201, 202 is provided with an inwardly extending flange 2010, 2020 which engages the respective block member 425 so as to prevent disengagement of the seat member 20 from the guide rods 413. The second channel 203 has a rear end portion which is formed with an inwardly projecting stop member 2031. A pressing plate 417 is sleeved on the bit guide 415 of the guide unit 4 and has two pressing sections 4170 (just one is shown) which extend respectively to the mounting grooves 4110 to press against the indented sections 510 of the inwardly extending protrusions 512. A spring member 416 is sleeved on the bit guide 415 of the guide unit 4 and is disposed between the stop member 2031 and the pressing plate 417 so as to bias normally the seat member 20 toward an initial position and to bias normally the pressing plate 417 to press against the inwardly extending protrusions 512 of the housing 51. The seat member 20 of the actuating unit 2 is formed with a longitudinally extending slit 21 which is communicated with the first channel 201. The actuating unit 2 further includes an elongated actuating member 22 which extends in the first channel 201 of the seat member 20 and which has a head portion 221 that extends into the housing 51 through the guide rod 413 between the vertical walls 514. The actuating member 22 has a tail portion to which a post 222 is connected. The post 222 defines a transverse section of the tail portion of the actuating member 22 and extends into the slit 21. The head portion 221 of the actuating member 22 is formed with a transverse bar 2210. The transverse bar 2210 normally abuts against the first guide surface 551 of each of the guide members 55. A spring member 25 is sleeved on the actuating member 22 and is disposed between the stop member 4130 of the guide rod 413 and the head portion 221 of the actuating member 22.

The elongated hollow casing 3 has open front and rear ends and includes first and second longitudinal casing halves (3A, 3B) which are connected releasably to each other. The casing 3 receives the housing 51 of the receiving unit 5, the guide unit 4 and the seat member 20 therein. The open front end of the casing 3 is provided with a stop means. In the present embodiment, the stop means is a pair of opposed inwardly extending flanges 36. Each of the flanges 36 is formed on an inner surface of a respective one of the first and second casing halves (3A,3B). The inwardly extending flanges 36 engage releasably the outwardly extending projections 512 of the housing 51 of the feed belt receiving unit 5 so as to prevent disengagement of the guide unit 4 and the receiving unit 5 from the open front end of the hollow casing 3. The casing 3 has an inwardly projecting flange 30 (FIG. 3) adjacent to the open rear end thereof. As best shown in FIG. 3, the flange 30 normally engages the seat member 20 so as to enable the seat member 20 to move synchronously with the casing 3 relative to the mounting seat 41 of the guide unit 4. The hollow casing 3 has a bottom wall which is formed with a notch unit that extends from the front end thereof. In the present embodiment, the notch unit is a notch 31 formed in each of the casing halves (3A,3B) adjacent the inwardly extending flange 36. Each of the notches 31 is aligned with a respective one of the outwardly extending projections 512 when the seat member 20 is located in the initial position. The flange 36 of the second casing half (3B) has a cut-out 37 in which the guide plate 53 extends. The second casing half (3B) is formed with a through-hole 35 and a plurality of angularly spaced positioning recesses 351 around the through-hole 35. The casing 3 is formed with an annular groove 38 between the open rear end and the flange 30.

An eccentric stop plate 34 is disposed in the casing 3 and has a locking pin 341 which extends through the through-hole 35. A knob 33 is mounted securely on the locking pin 341 by extending a locking bolt through the knob 33 and into the locking pin 341. Two opposed steel balls 332 are provided between the knob 33 and the second casing half (3B) and are received releasably in two of the recesses 351. The steel balls 332 are movable to other ones of the recesses 351 when the knob 33 rotates relative to the casing.

The hollow connector 32 has a front end portion which is formed with a radially and outwardly extending flange 322 and a rear open end 321 which is adapted to be coupled releasably to the automatic screw driving device 6 (FIG. 5). The flange 322 of the hollow connector 32 engages the groove 38 of the casing 3 so as to permit rotation of the hollow connector 32 relative to the casing 3.

Referring now to FIGS. 1, 2, 3 and 4, in assembly, the locking pin 341 of the eccentric stop plate 34 initially extends through the through-hole 35 of the second casing half (3B) and is connected to the knob 33. At the same time, the opposed steel balls 332 are received in two of the recesses 351. The second casing half (3B) is connected to the first casing half (3A) by means of screws to form the casing 3 while the flange 322 of the connector 32 engages the groove 38 of the casing 3. Then, the actuating unit 2 and the guide unit 4 are received in the casing 3 via the open front end of the latter. At this time, the mounting grooves 4110 of the mounting seat 41 of the guide unit 4 are in alignment with the respective notch 31 of the casing 3. Aligning the inwardly extending protrusions 512 of the housing 51 of the receiving unit 5 with the mounting groove 4110 and moving the protrusions 512 into the respective groove 4110 via the respective notch 31 relative to the casing 3 results in the engagement of the protrusions 512 with the respective groove 4110. At this stage, the pressing sections 4170 of the pressing member 417 press against the indented sections 510 of the inwardly extending protrusions 512 so as to prevent free movement of the housing 51 of the receiving unit 5 relative to the mounting seat 41 of the guide unit 4, while the outwardly extending projections 518 of the housing 51 engage the inwardly extending flanges 36 so as to prevent disengagement of the guide unit 4 and the receiving unit 5 from the open front end of the casing 3. After the guide unit 4 engages the receiving unit 5, the transverse bar 2210 abuts against the first guide surfaces 551 of the guide members 55. Lastly, the guide plate 53 is connected to the housing 51 by means of the locking bolt 54. Since the guide plate 53 is retained in the cut-out 37 of the flange 36, movement of the housing 51 toward the bottom wall of the casing 3 is prohibited, thereby preventing disengagement of the protrusions 512 from the groove 4110 through the notches 31.

Referring now to FIGS. 4, 5 and 6, in operation, the automatic screw driving device 6 is firstly attached to the open rear end 321 of the hollow connector 32. The tool bit 61 extends through the second channel 203 of the seat member 20 and into the bit guide 415 of the guide unit 4. The feed belt 9 is then received in the housing 51 of the receiving unit 5 via the belt passage 511. One of the engaging units 93 on each side of the feed belt 9 engages one of the teeth 520 of the ratchet wheels 52. The head 921 of a first screw 92 is aligned with the tool bit 61 of the driving device 6. To drive the screw 92 into the operating surface 7, the front end of the guide plate 53 firstly engages the operating surface 7. A pushing force is then applied to the driving device 6 so as to push the latter toward the operating surface 7 in order to slidably move the casing 3. Since the casing 3 normally engages the seat member 20, the seat member 20 is thus enabled to move synchronously with the casing 3 relative to the mounting seat 41 of the guide unit 4 from the initial position to a second position, wherein the tool bit 61 extends into the housing 51 of the receiving unit 5 to drive rotatably the first screw 92 into the operating surface and release the first screw 92 from the strap 91 during a screw driving operation. The spring member 416 is located at a compressed state when the seat member 20 and the casing 3 are located in the second position.

At the time the casing 3 and the seat member 20 move from the initial position to the second position, the actuating member 22 moves toward the front end portion of the housing 51 such that the two ends of the transverse bar 2210 of the actuating member 22 move past the respective first guide surfaces 551 of the guide member 55 to reach the slant surfaces 5150 of the guide protuberants 515. The slant surfaces 5150 guide the ends of the transverse bar 2210 to abut against the second guide surfaces 552 of the guide members 55. It should be noted that, since the spring member 45 is initially compressed and since the block member 425 is initially spaced from the post 222, the actuating member 22 does not move toward the front end of the housing 51 at the time the casing 3 and the seat member 20 initially move from the initial position to the second position until the post 222 abuts against the block member 425.

After the screw driving operation has been completed, the pushing force applied on the driving device 6 is released, causing the spring member 416 to expand to thereby move the casing 3 and the seat member 20 back to the initial position. When the casing 3 and the seat member 20 move back to the initial position, the ends of the transverse bar 2210 of the actuating member 22 are guided by the second guide surfaces 552 of the guide members 55 to move into the tooth space formed between two adjacent teeth 520 of the respective ratchet wheels 52, thereby causing limited clockwise movement of the ratchet wheels 52. The ratchet wheels 52 move the feed belt 9 by a corresponding distance so as to engage respectively a succeeding one of the engaging units on the sides of the feed belt 9 and to position the head 921 of a second screw 92 directly in front of the tool bit 61. The preferred embodiment is now ready for a second screw driving operation.

It should be appreciated that the distance between the front end portion of the housing 51 and the front end of the guide plate 53 represents the length of a screw to be driven. Therefore, the distance between the front end portion of the housing 51 and the front end of the guide plate 53 must be variable depending on the length of the screw to be driven. To achieve this, the locking bolt 54 is firstly released. The guide plate 53 is then adjusted relative to the housing 51 of the receiving unit 5 to a position where the locking bolt 54 is aligned with another one of the position holes 532 and the distance between the front end of the guide plate 53 and the front end portion of the housing 51 is equal to the length of the screw to be driven.

It should be noted that the distance between two adjacent positioning holes 532 is determined according to the length of different standard screws. However, since the length of some screws may be different from that of the standard screws due to the shape of the head of the screw, varying the distance between the front end of the guide plate 53 and the front end portion of the housing 51 may be insufficient. At this time, variation of the distance traveled by the driving device 6 is needed. Since the rear end of the guide plate 53 will abut against the periphery of the stop plate 34 when the casing is located in the second position, and since the stop plate 34 is eccentric, rotation of the knob 33 results in variation of the distance formed between the periphery of the stop plate 34 and the rear end of the guide plate 53 when the seat member 20 and the casing 3 are located in the initial position, thereby varying the distance traveled by the driving device 6 during the movement of the seat member 20 and the casing 3 from the initial position to the second position.

Moreover, since the hollow connector 32 is rotatable relative to the casing 3, the driving device 6, which is connected threadably to the connector 32, is thus rotatable relative to the casing 3, thereby facilitating the driving operation.

During disassembly, the locking bolt 54 is firstly released. The housing 51 is then lifted relative to the mounting seat 41 so as to disengage the protrusions 512 from the grooves 4110 through the notches 31. Lastly, the mounting seat 41 and the seat member 20 are pulled through the open front end of the casing 3.

Accordingly, the automatic screw feeding mechanism of the present invention has the following advantages:

1. Since the present invention can be disassembled into a casing 3, a guide unit 4, an actuating unit 2 and a receiving unit 5, assembly and disassembly of the present invention can be easily and rapidly conducted, thus facilitating maintenance and repair of the present invention.
2. Since the driving device 6 can rotate relative to the casing 3, it is convenient to drive a screw into different operating surfaces.
3. Variation of the distance between the front end of the guide plate 53 and the front end portion of the housing 51, and variation of the distance between the periphery of the stop plate 34 and the rear end of the guide plate 53 adopts the present invention for use with different types of screws.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An automatic screw feeding mechanism for an automatic screw driving device, said automatic screw driving device including a rotatable tool bit and means for axially rotating the tool bit, said automatic screw feeding mechanism being adapted for use with a feed belt which includes an elongated strap that holds a plurality of spaced and aligned screws, said strap having two opposed longitudinal sides provided with a plurality of spaced engaging units, said automatic screw feeding mechanism comprising:

a feed belt receiving unit including a hollow housing having a front end portion formed with a belt passage that permits passage of the feed belt therethrough and an open rear end portion which is provided with a limiting unit and which permits extension of the tool bit therethrough and into said housing, said receiving unit further including retaining means which is adapted to engage releasably the engaging units on the strap of the feed belt to align one of the screws with the tool bit;

a guide plate which is connected to said housing of said feed belt receiving unit and which has a front end that is spaced apart from said front end portion of said housing and that is adapted to engage an operating surface;

an elongated guide unit having a front end with a connection portion which is connected releasably to said open rear end portion of said housing of said feed belt receiving unit, said guide unit being formed with a longitudinal passage to permit passage of the tool bit therethrough and into said housing;

an actuating unit including a seat member connected movably to said guide unit, said seat member being movable forward and rearward relative to said guide unit, said actuating unit further including an elongated actuating member which is disposed in said seat member and which extends into said housing via said guide unit; and an elongated hollow casing having open front and rear ends, said open rear end being adapted to be coupled releasably to one end of the automatic screw driving device, said casing receiving said housing of said feed belt receiving unit, said guide unit and said seat member therein, said open front end being provided with a stop means which engages releasably said limiting unit of said housing of said feed belt receiving unit so as to prevent disengagement of said guide unit and said receiving unit from said open front end of said hollow casing, said casing normally engaging said seat member so as to enable said seat member to move synchronously with said casing relative to said guide unit from an initial position to a second position, wherein the tool bit extends into said housing of said receiving unit to drive rotatably an aligned one of the screws into the operating surface and release the aligned one of the screws from the strap during a screw driving operation, when said casing is urged by the automatic screw driving device, said casing and said seat member being movable back to the initial position after the execution of the screw driving operation, said actuating member actuating said retaining means to engage succeeding ones of the engaging units on the feed belt in order to align a succeeding one of the screws with the tool bit when said casing moves back to the initial position.

2. An automatic screw feeding mechanism as claimed in claim 1, wherein said stop means is a pair of opposed inwardly extending flanges, and said limiting unit is a pair of opposed outwardly extending projections.

3. An automatic screw feeding mechanism as claimed in claim 1, wherein:

said elongated guide unit includes a mounting seat having two opposite side walls and a mounting wall interconnecting said side walls, each of said side walls being formed with a mounting groove, said guide unit further including a hollow guide rod extending from said mounting wall of said mounting seat toward said open rear end of said casing and a hollow bit guide extending parallel to said guide rod said rear end portion of said housing of said feed belt receiving unit has two opposed vertical walls on which said limiting unit is provided, each of said vertical walls being provided with an inwardly extending protrusion which engages releasably and respectively said mounting grooves; and said seat member is formed with first and second channels into which said guide rod and said bit guide extend respectively and slidably to mount slidably said seat member to said mounting seat.

4. An automatic screw feeding mechanism as claimed in claim 3, wherein said second channel has a rear end portion which is formed with an inwardly projecting stop member, said guide unit further including a spring member sleeved on said bit guide and disposed between said stop member and said mounting seat so as to bias normally said seat member and said casing toward said initial position.

5. An automatic screw feeding mechanism as claimed in claim 3, wherein said seat member of said actuating unit is formed with a longitudinally extending slit communicated with said first channel, said actuating member extending in said first channel and having a head portion which extends into said housing through said guide rod between said vertical walls and a tail portion which is provided with a transverse section extending into said slit, said head portion activating said retaining means when said casing moves back to the initial position.

6. An automatic screw feeding mechanism s claimed in claim 5, wherein said head portion of said actuating member is formed with a transverse bar, said retaining means of said feed belt receiving unit including a ratchet wheel which is mounted rotatably on an inner surface of each of said vertical walls and which has a periphery formed with a plurality of angularly spaced teeth, and a pawl member associated with said ratchet wheels to arrest counterclockwise rotation of said ratchet wheels, said feed belt receiving unit further including a guide member mounted on each of said inner surfaces of said vertical walls for guiding said transverse bar of said actuating member to drive rotatably said ratchet wheels when said casing and said seat member move back to said initial position so as to align the succeeding one of the screws with the tool bit.

7. An automatic screw feeding mechanism as claimed in claim 6, wherein said guide rod has a distal end portion which is formed with an inwardly projecting stop member, said actuating member further having a spring member which is sleeved thereon and which is disposed between said stop member and said head portion, said transverse section of said actuating member extending out of said first channel and into said slit.

8. An automatic screw feeding mechanism as claimed in claim 1, wherein said guide plate is formed with a series of longitudinally arranged positioning holes, said receiving unit further including a locking bolt which extends through a selected one of said positioning holes and which engages threadedly said housing.

9. An automatic screw feeding mechanism as claimed in claim 1, further comprising a hollow connector having a front end portion which is mounted rotatably to said open rear end of said casing and a rear open end which is adapted to be coupled releasably to the automatic screw driving device.

10. An automatic screw feeding mechanism as claimed in claim 1, wherein one of said first and second casing halves of said casing is formed with a through-hole and a plurality of angularly spaced positioning recesses around said through-hole, said automatic screw feeding mechanism further comprising an eccentric stop plate which is disposed in said casing and which has a locking pin extending through said through-hole and a periphery abutting against said guide plate when said casing moves to said second position, a knob mounted securely on said locking pin such that rotation of said knob results in rotation of said stop plate so as to vary distance formed between said front end of said guide plate and said front end of said casing when said casing is located in said second position, and two opposed steel balls which are provided between said knob and said one of said first and second casing halves and which are received releasably in two of said recesses, said steel balls being movable to other ones of said recesses when said knob rotates relative to said casing.

11. An automatic screw feeding mechanism as claimed in claim 2, wherein:

said hollow casing has a bottom wall formed with a notch unit which extends from said open from end;

said guide unit has two opposed side walls, each of said side walls being formed with a mounting groove; and said housing has two vertical walls on which said limiting unit is provided, each of said vertical walls having a protrusion which engages releasably said mounting groove whereby, said guide unit and said receiving unit are detachable from said casing by lifting said housing relative to said guide unit so as to disengage said protrusions of said housing from said grooves of said guide unit through said notch unit of said casing and pulling said guide unit through said open front end of said casing after said housing has been removed.

* * * * *